US012546020B2

(12) United States Patent
Coll

(10) Patent No.: US 12,546,020 B2
(45) Date of Patent: Feb. 10, 2026

(54) ELECTROPLATING BATH FOR DEPOSITING CHROMIUM OR CHROMIUM ALLOY AND PROCESS FOR DEPOSITING CHROMIUM OR CHROMIUM ALLOY

(71) Applicant: MacDermid, Incorporated, Waterbury, CT (US)

(72) Inventor: Yoann Coll, Clichy (FR)

(73) Assignee: MacDermid, Incorporated, Waterbury, CT (US)

( * ) Notice: Subject to any disclaimer, the term of this patent is extended or adjusted under 35 U.S.C. 154(b) by 315 days.

(21) Appl. No.: 18/036,520

(22) PCT Filed: Dec. 28, 2021

(86) PCT No.: PCT/EP2021/087715
§ 371 (c)(1),
(2) Date: May 11, 2023

(87) PCT Pub. No.: WO2022/148691
PCT Pub. Date: Jul. 14, 2022

(65) Prior Publication Data

US 2025/0263861 A1 Aug. 21, 2025

(30) Foreign Application Priority Data

Jan. 5, 2021 (EP) ..... 21150297

(51) Int. Cl.
*C25D 3/10* (2006.01)
*C25D 3/06* (2006.01)

(52) U.S. Cl.
CPC *C25D 3/10* (2013.01); *C25D 3/06* (2013.01)

(58) Field of Classification Search
None
See application file for complete search history.

(56) References Cited

U.S. PATENT DOCUMENTS

| | | | | |
|---|---|---|---|---|
| 4,167,460 | A | 9/1979 | Tomaszewski | |
| 4,184,929 | A | 1/1980 | Tomaszewski et al. | |
| 2017/0009361 | A1 * | 1/2017 | Dal Ziliio | C25D 3/10 |

FOREIGN PATENT DOCUMENTS

| | | | | |
|---|---|---|---|---|
| CN | 101665960 | A | 3/2010 | |
| CN | 105696028 | A | 6/2016 | |
| CN | 107419310 | A | 12/2017 | |
| CN | 108034969 | A | 5/2018 | |
| CN | 110512240 | A * | 11/2019 | C25D 3/06 |
| EP | 2899299 | A1 | 7/2015 | |
| JP | 2002285375 | A | 10/2002 | |

OTHER PUBLICATIONS

Machine translation of Chen et al. CN 110512240 A (Year: 2019).*
Benaben, Patrick. An Overview of Hard Chromium Plating Using Trivalent Chromium Solutions. Published Jan. 31, 2011 https://www.pfonline.com/articles/an-overview-of-hard-chromium-plating-using-trivalent-chromium-solutions (last accessed Nov. 10, 2023).
Zeng, Zhixiang et al. A Review of Recent Patents on Trivalent Chromium Platings.

* cited by examiner

*Primary Examiner* — Wojciech Haske
(74) *Attorney, Agent, or Firm* — Carmody Torrance Sandak & Hennessey LLP

(57) ABSTRACT

An electroplating bath for depositing chromium or chromium alloys from a trivalent chromium bath that includes: (1) at least one trivalent chromium ion, (2) at least one complexing agent, (3) at least one halogen salt, and (4) at least one stabilizing agent which is different from the complexing agent, wherein the electroplating bath has a pH from 4 to 7 and is substantially free of divalent sulphur compounds and boric acid, its salts and/or derivatives and wherein the molar ratio of the complexing agent to the trivalent chromium ion is from 8:1 to 15:1. A process for depositing chromium or chromium alloys onto a substrate is also included.

22 Claims, 4 Drawing Sheets

ELECTROPLATING BATH FOR DEPOSITING CHROMIUM OR CHROMIUM ALLOY AND PROCESS FOR DEPOSITING CHROMIUM OR CHROMIUM ALLOY

FIELD OF THE INVENTION

The present invention refers to an electroplating bath for depositing chromium or chromium alloys and a process for depositing chromium on a substrate.

BACKGROUND OF THE INVENTION

In the field of chrome plating, trivalent chromium bath has gained a significant role in the chrome plating industry due to its lower toxicity. However, despite its advantages, the use of trivalent chromium bath is not without drawbacks.

One of those drawbacks is that the bath needs a close monitoring regarding the efficiency of the bath. The trivalent chromium bath is not always stable and need to be changed on a regular basis.

Benaben, P. (2011). An overview of hard chromium plating using trivalent chromium solutions. National Association for Surface Finishing Annual Conference and Trade Show 2010, SUR/FIN 2010. 2 discloses different baths used to obtain a trivalent chromium plating electrolyte with boric acid.

Zeng, Zhixiang & Liang, Aiming & Zhang, Junyan. (2009). A Review of Recent Patents on Trivalent Chromium Plating. Recent Patents on Materials Science. 2. 50-57. 10.2174/1874465610902010050 gives an overview about patents in the field of trivalent chrome plating. There is a part specific about hexavalent chromium reduction and its elimination via electrolytic purification.

U.S. Pat. No. 4,167,460 A discloses an aqueous acidic trivalent chromium electroplating solution and process for depositing chromium plating employing a bath containing trivalent chromium, a complexing agent, a reducing agent and a controlled effective amount of an anionic or non-ionic surface active agent selected from the class of organic mono- or di- or tri-ester phosphates which contributes to improve operating characteristics and efficiency of the electroplating bath and enhances the uniformity of the chromium deposit.

U.S. Pat. No. 4,184,929 A discloses an aqueous acid trivalent chromium electroplating solution and process for forming chromium plating employing a bath containing trivalent chromium, formate ions as a complexing agent, and a bath soluble reducing agent selected from the group consisting of formaldehyde, glyoxal, formaldehyde bisulfite, glyoxal di-bisulfite, sodium formaldehyde sulfoxylate, and mixtures thereof.

None of those prior art documents has focused on the impact of specific agents as stabilizers to improve the lifetime of the electroplating bath.

SUMMARY OF THE INVENTION

It was therefore an object of the present invention to provide an electroplating bath for depositing chromium or chromium alloys with a trivalent chrome bath with improved stability.

This problem is solved by the electroplating bath with the features of claim 1 and the process for depositing chromium or chromium alloys on a substrate with the features of claim 13. The further dependent claims mention preferred embodiments.

According to the present invention, an electroplating bath for depositing chromium or chromium alloys from a trivalent chromium bath comprising:

a) 0.2 to 1 mol/L of at least one trivalent chromium ion,
b) 2 to 10 mol/L of at least one complexing agent,
c) 0.01 to 0.5 mol/L of at least one halogen salt,
d) 0.01 to 1 mol/L of at least one stabilizing agent which is different from the complexing agent, wherein the electroplating bath has a pH from 4 to 7 and is substantially free of divalent sulphur compounds and boric acid, its salts and/or derivatives and wherein the molar ratio of the complexing agent to the trivalent chromium ion is from 8:1 to 15:1.

wherein the at least one stabilizing agent is selected from the group consisting of oxalic acid, glycolic acid, tartaric acid, ascorbic acid, pyruvic acid, glyoxylic acid, thioglycolic acid and mixtures thereof wherein the at least one complexing agent is selected from the group consisting of formic acid, acetic acid, propionic acid, lactic acid, malic acid, citric acid, succinic acid, gluconic acid, glycine, aspartic acid, glutamic acid, and mixtures thereof.

DETAILED DESCRIPTION OF THE PREFERRED EMBODIMENTS

Figure 1:
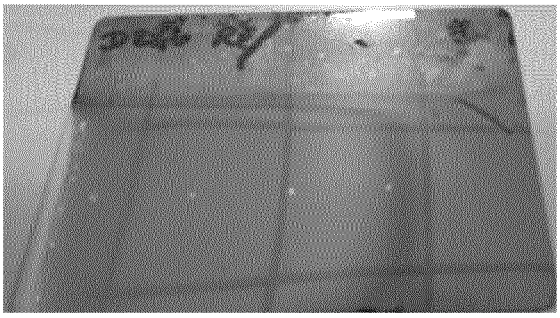
FIG. 1 shows a Hull cell plating realized with a bath containing no organic acid to serve as a reference.
Figure 2:
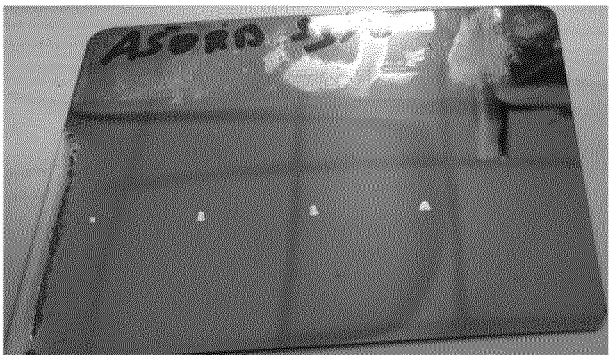
FIG. 2 shows a Hull cell plating realized with a bath containing 5 g/L Ascorbic acid.
Figure 3:
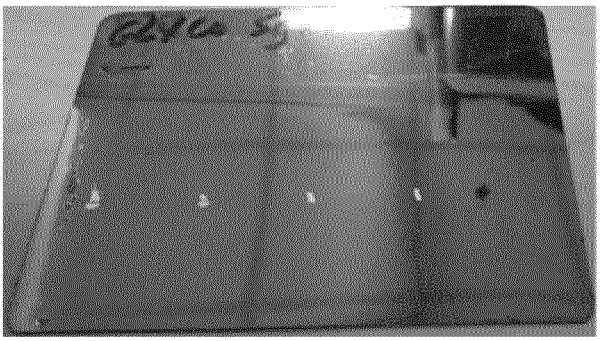
FIG. 3 shows a Hull cell plating realized with a bath containing 5 g/L Glycolic acid.
Figure 4:
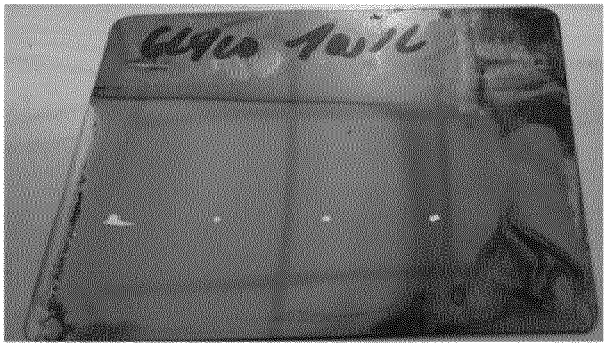
FIG. 4 shows a Hull cell plating realized with a bath containing 10 g/L Glycolic acid.
Figure 5:
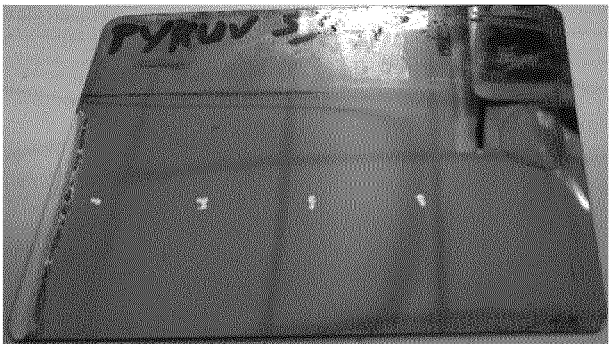
FIG. 5 shows a Hull cell plating realized with a bath containing 5 g/L Pyruvic acid.
Figure 6:
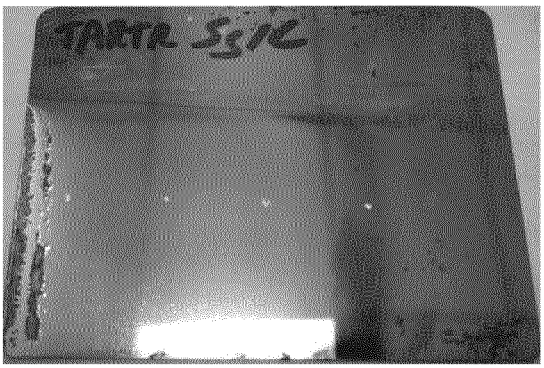
FIG. 6 shows a Hull cell plating realized with a bath containing 5 g/L Tartaric acid.
Figure 7:
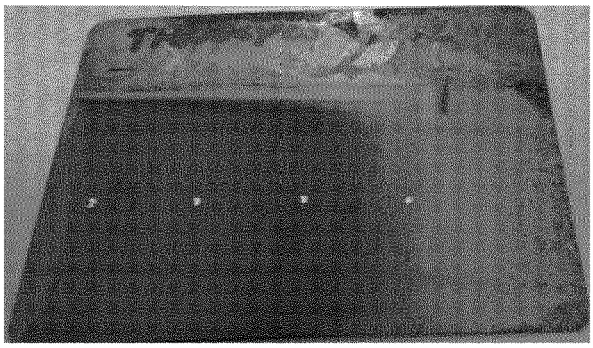
FIG. 7 shows a Hull cell plating realized with a bath containing 5 g/L Thioglycolic acid.

Surprisingly, it has also been found that the stabilizing agent does not only improve the lifetime of the bath but is also able to reduce significantly the amount of hexavalent chromium which is generally present in a bath of trivalent chromium as an impurity.

Trivalent chrome baths need to be controlled closely for metallic impurities especially for hexavalent chromium. Furthermore, its salts are listed in the SVHC (Substances of Very High Concern) in the European REACH (Regulation, Evaluation, Authorisation and Restriction of Chemicals) regulation project, which should ban its use from 2024. Hexavalent chromium is typically created at the anode from trivalent chromium ions in an undesired oxidation reaction.

It is mandatory to reduce or even suppress its formation, as its presence has a negative impact on the plated layer. For example, an amount such as 5 mg/L of hexavalent chromium in a trivalent chromium plating bath is sufficient to completely destabilize deposition and is therefore unacceptable.

In a preferred embodiment, the stabilizing agent is present in an amount of 0.01 to 0.5 mol/L, preferably in an amount of 0.02 to 0.3 mol/L.

In a preferred embodiment, the at least one source of trivalent chromium salt is selected from the group consisting of chromium(III)sulphate, in acidic or alkaline form, chromi-um(III)chloride, chromium(III) acetate, chromium (III) hydroxy acetate, chromium(III) formate, chromium(III) formatesulfate, chromium(III) hydroxy formate, chromium (III) carbonate, chromium(III) methanesulfonate, potassium chromium(III) sulphate and mixtures thereof, preferably from the group consisting of chromium(III)sulphate, in acidic or alkaline form, chromium(III) acetate, chromium (III) hydroxy acetate, chromium(III) formate, chromium(III) formate-sulfate, chromium(III) hydroxy formate, chromium (III) carbonate, chromium(III) methanesulfonate, potassium chromium(III) sulphate and mixtures thereof.

In a more preferred embodiment, the at least one source of trivalent chromium salt is selected from the group consisting of chromium(III)sulphate, in acidic or alkaline form, chromium(III) formatesulfate and mixtures thereof.

In a preferred embodiment, the at least one trivalent chromium ion is present in an amount of 0.25 to 0.8 mol/L.

In a preferred embodiment, the at least one stabilizing agent is selected from the group consisting of glycolic acid, tartaric acid, ascorbic acid, pyruvic acid, oxalic acid and mixtures thereof, or their salts and mixtures thereof.

In a preferred embodiment, the electroplating bath is substantially free of chloride ions and/or substantially free of aluminium ions.

In a preferred embodiment, the at least one complexing agent is present in an amount of 2 to 10 mol/L, prefer-ably 3 to 7 mol/L and/or the molar ratio of the complexing agent to the trivalent chromium ion is from 9:1 to 14:1, preferably from 10:1 to 13:1.

In a preferred embodiment, the at least one halogen salt is selected from the group consisting of bromide, chloride, iodide, fluoride salts, preferably bromide, iodide, fluoride salts, more preferably potassium bromide, sodium bromide, ammonium bromide and mixtures thereof.

In a preferred embodiment, the at least halogen salt is present in an amount of 0.01 to 0.5 mol/L.

In a preferred embodiment, the bath comprises 1 mg/L to 10 g/L, preferably 5 to 500 mg/L of at least one additive, which is preferably selected from the group consisting of

- brighteners, such as a polyamine or a mixture of polyamines including quaternary ammonium compounds,
- wetting agents, like electroneutral, cationic and amphoteric surfactants and
- combinations thereof.

In a preferred embodiment, the anion of the trivalent chromium ion is the anion of a volatile or electrochemically consumable acid.

In a more preferred embodiment, the anion of a volatile or electrochemically consumable acid is selected from the group consisting of formate, acetate, proprionate, glycolate, oxalate, carbonate, citrate or mixtures thereof.

In a preferred embodiment, the anion of the trivalent chromium ion is a sulfate anion.

According to the present invention, a process for depositing chromium or chromium alloys on a substrate from a trivalent chromium bath is also provided including the following steps:

- Providing an electroplating bath of any of the preceding claims,
- Immersing a substrate in the electroplating bath and
- Applying an electrical current to deposit on the substrate.

In a preferred embodiment, the electroplating bath is separated from the anode by a membrane, preferably an anionic or cationic exchange membrane or a porous membrane, more preferably a cationic exchange membrane, defining an anolyte and a catholyte.

In a preferred embodiment, the electroplating is done using pulsed current.

In a preferred embodiment, the anolyte comprises chromium(III) sulphate.

In a preferred embodiment, the temperature of the bath is comprised from 20 to 70° C., preferably from 30 to 65° C., more preferably from 40 to 60° C.

With reference to the following figures and examples, the subject matter according to the present invention is intended to be explained in more detail without wishing to restrict said subject matter to the specific embodiments shown here.

EXAMPLES

High performance liquid chromatography (HPLC) was realised on a Shimadzu Nexera XR with a column Allsep Anion 7 μm 4.6×250 mm Alltech 3091917.1.

Plating thickness was measured by X-ray fluorescence with an internal calibrated method on a XRF spectrometer FISCHERSCOPE® X-RAY XAN® 222 from FISCHER company.

Evaluation of the Effect of Glycolic Acid as a Stabilizing Agent:

A bath was made with the following components 0.38 M of trivalent chromium ion 5.43 M of formic acid 5.3 M of $NH_3$ 0.085 M KBr 1 g/l quaternary ammonium compound Complexation was made during 2 hours at 60° C.

First different concentrations of glycolic acid were used to see the stabilizing effect on the bath. Different baths were prepared with glycolic acid concentration (0, 0.039M, 0.11M, 0.39M, 0.78M). The baths were left for one month at ambient temperature and the aspect of the bath was observed. Only the bath with no glycolic acid shows a precipitation of trivalent chromium.

After, the effect of the glycolic acid on the concentration of hexavalent chromium was investigated. For this purpose, the baths were realised as stated above with a concentration of 0.11M of glycolic acid.

A determined concentration of hexavalent chromium under sodium dichromate form ($Na_2Cr_2O_7$, $2H_2O$) was added and its concentration was monitored by HPLC (UV analysis with diphenylcarbazide at 540 nm).

For all the examples, a concentration of hexavalent chromium that is higher than the one that would normally be found in an operating trivalent chromium plating bath (about the range of the mg/L) was chosen. It was made to properly measure the decrease in hexavalent chromium with the stabilizing agent.

When the value was close to zero, other additions were done to check until when its reduction is no more possible.

The reaction at room temperature and at bath working temperature was compared (55° C.—maintained only during the working day).

TABLE 1

| Monitoring of the concentration of $Cr^{VI}$ in the plating bath | | |
|---|---|---|
| g/L | Room Temp. | 55° C. |
| Addition of 2 g/L of $Cr^{VI}$ | | |
| J0 | 2 | 1.7 |
| J + 1 | 1.5 | 0.191 |
| J + 2 | 1.3 | 0.018 |
| J + 3 | 1.1 | <1 mg/L |
| J + 4 | 0.886 | <1 mg/L |
| Addition of 4 g/L of $Cr^{VI}$ | | |
| J0 | 4.5 | 4 |
| J + 7 | 1.9 | 0.37 |
| J + 20 | 0.255 | 0.061 |
| Addition of 4 g/L of $Cr^{VI}$ | | |
| J0 | 4.7 | 4.5 |
| J + 12 | 4.5 | 1.8 |

A decrease of the concentration of hexavalent chrome with a higher rate of reduction was observed at the 55° C. temperature. All the components of the bath were analysed, and a decrease of Glycolic acid concentration was observed, after hexavalent chromium introduction into the bath. This decrease of Glycolic acid was monitored.

TABLE 2

| Monitoring of the concentration of glycolic acid in the plating bath | | | | | |
|---|---|---|---|---|---|
| | | | Glycolic acid 57% | | |
| | Hexavalent Cr | | | | Ref |
| g/L | Room Temp | 55° C. | T | 55° C. | (No CrVI) |
| Addition of 2 g/L of CrVI | | | | | |
| J0 | 2 | 1.7 | 8.3 | 8.3 | 8.3 |
| J + 1 | 1.5 | 0.191 | | | |
| J + 2 | 1.3 | 0.018 | | | |
| J + 3 | 1.1 | <1 mg/L | | | |
| J + 4 | 0.886 | <1 mg/L | 6.54 | 6.33 | — |
| Addition of 4 g/L of CrVI | | | | | |
| J0 | 4.5 | 4 | | | |
| J + 7 | 1.9 | 0.37 | | | |
| J + 20 | 0.255 | 0.061 | | | |
| Addition of 4 g/L of CrVI | | | | | |
| J0 | 4.7 | 4.5 | | | |
| J + 12 | 4.5 | 1.8 | 2.38 | 0.95 | 8.3 |

The concentration of glycolic acid does not change in the absence of hexavalent chrome in the bath. At higher temperature, the decrease in concentration of glycolic acid is more important.

Glycolic acid is certainly oxidized in glyoxylic acid, during hexavalent chromium reduction, but as it is unstable at this pH it is certainly degraded to oxalic acid.

As expected, no oxalic acid was found in a new bath but 0.65 g/L in the bath in which hexavalent chromium was added and maintained at 55° C.

To confirm, a new bath without glycolic acid was made up and introduced around 4.5 g/L of hexavalent chromium The chromium content was analysed after 15 days at 55° C. (temperature maintained during working hours).

TABLE 3

| Variation of the concentration hexavalent chrome in a bath without any glycolic acid | |
|---|---|
| Addition of 4.5 g/L of $Cr^{VI}$ | 55° C. |
| J0 | 4.4 g/L |
| J + 15 | 2.2 g/L |

A reduction of hexavalent chromium concentration was observed but far from what was measured before.

This bath was then split in half. One was let as it is and in the other one, a "make-up concentration" of glycolic acid was added.

The hexavalent chromium concentration was measured after 21 additional days at room temperature.

TABLE 4

| Comparison of the concentration of hexavalent chrome in a bath with and without glycolic acid | | |
|---|---|---|
| | With glycolic acid | Without glycolic acid |
| J + 21 | 0.45 g/L | 2.1 g/L |

The effect of glycolic acid, on hexavalent chromium reduction, is clearly proved, even if it doesn't have an effect alone but certainly it acts as a catalyst of this reduction reaction.

So, if formed, hexavalent chromium is reduced in a trivalent chrome bath with glycolic acid and with higher efficiency at working bath temperature.

Testing New Molecules as a Stabilizing Agent:

In order to complete previous trials, the ability of several molecules, with similar structures to glycolic acid, to reduce hexavalent chromium in trivalent chromium bath was evaluated. The molecules that were chosen are acetic acid, propionic acid, malic acid, tartaric acid, lactic acid, glyoxylic acid, pyruvic acid, succinic acid, thioglycolic acid, benzoic acid and ascorbic acid.

Similar test with those stabilizing agents were conducted, and the concentration was measured 3 weeks after hexavalent chromium addition to obtain a starting concentration 4 g/L.

TABLE 5

| Final concentration of $Cr^{VI}$ depending on the stabilizing agent | |
|---|---|
| Molecule tested | Concentration 3 weeks after addition of $Cr^{VI}$ |
| Glycolic acid | 3.5 g/L |
| Ascorbic acid | 0.02 g/L |
| Pyruvic acid | 3.2 g/L |
| Glyoxylic acid | 1 g/L |
| Tartaric acid | 3.4 g/L |
| Thioglycolic acid | 3.2 g/L |

Interesting to see that for the same amount of hexavalent chromium, not all compounds are consumed in the same proportion.

Their effect on plating is evaluated with hull cell (10 A-10 min) and can be seen on the FIG. 1 to 7. No bad effect on the plating is observed except for thioglycolic acid.

Figure 8:
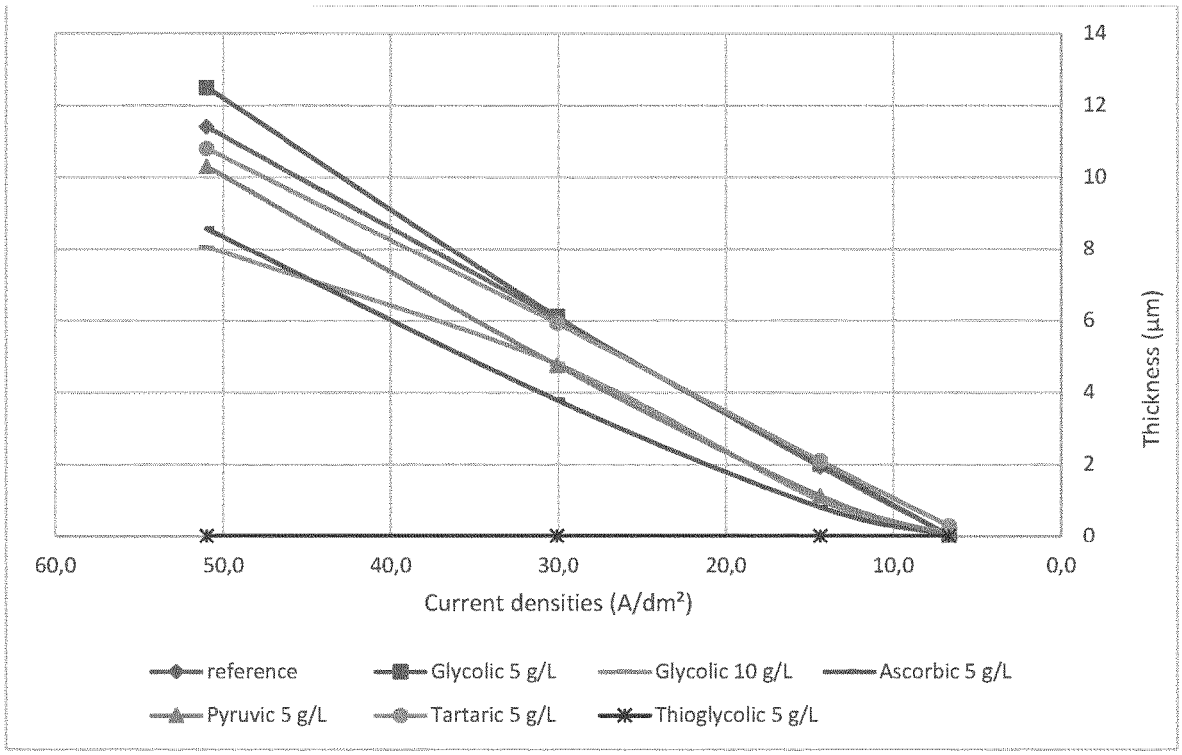
FIG. 8 shows a graph representing the thickness of the plating depending on the current density used. Each line represents a different stabilizing agent.

The FIG. 8 shows also a small difference in plating thickness except for the Thioglycolic acid where there is no plating.

So, all the molecules tested except the Thioglycolic acid have an effect as a stabilizing agent.

The invention claimed is:

1. An electroplating bath for depositing chromium or chromium alloys from a trivalent chromium bath comprising:

a) 0.2 to 1 mol/L of at least one trivalent chromium ion, b) 2 to 10 mol/L of at least one complexing agent, wherein the at least one complexing agent is selected from the group consisting of formic acid, acetic acid, propionic acid, lactic acid, malic acid, citric acid, succinic acid, gluconic acid, glycine, aspartic acid, glutamic acid, and mixtures thereof, or their salts and mixtures thereof, c) 0.01 to 0.5 mol/L of at least one halogen salt, d) 0.01 to 1 mol/L of at least one stabilizing agent, wherein the at least one stabilizing agent is selected from the group consisting of glycolic acid, tartaric acid, pyruvic acid, and mixtures thereof, or their salts and mixtures thereof, e) 0 to 10 g/L of at least one additive, wherein the at least one additive is selected from the group consisting of:

brighteners, wetting agents, and combinations thereof, wherein the electroplating bath has a pH from 4 to 7 and is substantially free of divalent sulphur compounds and boric acid, its salts and/or derivatives and wherein the molar ratio of the complexing agent to the trivalent chromium ion is from 8:1 to 15:1, wherein the electroplating bath is substantially free of chloride ions.

2. The electroplating bath of claim 1, wherein the stabilizing agent is present in an amount of 0.01 to 0.5 mol/L.

3. The electroplating bath of claim 2, wherein the stabilizing agent is present in an amount of 0.02 to 0.3 mol/L.

4. The electroplating bath of claim 1, wherein the at least one trivalent chromium ion is a trivalent chromium salt selected from the group consisting of chromium(III)sulphate in acidic or alkaline form, chromium(III) acetate, chromium (III) hydroxy acetate, chromium(III) formate, chromium(III) formate-sulfate, chromium(III) hydroxy formate, chromium (III) carbonate, chromium(III) methanesulfonate, potassium chromium(III) sulphate and mixtures thereof.

5. The electroplating bath of claim 4, wherein the at least one source of trivalent chromium salt is selected from the group consisting of chromium(III)sulphate, chromium(III) acetate, chromium(III) hydroxy acetate, chromium(III) formate, chromium(III) formate-sulfate, chromium(III) hydroxy formate, chromium(III) carbonate, chromium(III) methanesulfonate, potassium chromium(III) sulphate and mixtures thereof.

6. The electroplating bath of claim 1, wherein the at least one trivalent chromium ion is present in an amount of 0.25 to 0.8 mol/L.

7. The electroplating bath of claim 1, wherein the electroplating bath is substantially free of aluminum ions.

8. The electroplating bath of claim 1, wherein the at least one halogen salt is selected from the group consisting of bromide, iodide, fluoride salts.

9. The electroplating bath of claim 8, wherein the at least one halogen salt is selected from the group consisting of potassium bromide, sodium bromide, ammonium bromide and mixtures thereof.

10. The electroplating bath of claim 1, wherein the brighteners are selected from the group consisting of a polyamine or a mixture of polyamines, including quaternary ammonium compounds, and wherein the wetting agents are selected from the group consisting of electroneutral, cationic and amphoteric surfactants.

11. The electroplating bath of claim 10, wherein the bath comprises 5 to 500 mg/L of the at least one additive.

12. The electroplating bath of claim 1, wherein the anion of the trivalent chromium ion is the anion of a volatile or electrochemically consumable acid, wherein the anion of the volatile or electrochemically consumable acid is selected from the group consisting of formate, acetate, proprionate, glycolate, oxalate, citrate, and mixtures thereof.

13. The electroplating bath of claim 12, wherein the anion of the trivalent chromium ion is a sulfate anion.

14. A process for depositing chromium or chromium alloys on a substrate from a trivalent chromium bath including the following steps:

a) providing an electroplating bath according to claim 1, b) immersing the substrate in the electroplating bath, and c) applying an electrical current to deposit the chromium on the substrate.

15. The process of claim 14, wherein the electroplating bath is separated from the anode by a membrane defining an anolyte and a catholyte.

16. The process according to claim 15, wherein the membrane is an anionic or cationic exchange membrane or a porous membrane.

17. The process according to claim 16, wherein the membrane is a cationic exchange membrane.

18. The electroplating bath of claim 1, wherein the at least one complexing agent is present in an amount of 3 to 7 mol/L.

19. The electroplating bath of claim 1, wherein the molar ratio of the complexing agent to the trivalent chromium ion is from 9:1 to 14:1.

20. The electroplating bath of claim 19, wherein the molar ratio of the complexing agent to the trivalent chromium ion is 10:1 to 13:1.

21. An electroplating bath for depositing chromium or chromium alloys from a trivalent chromium bath consisting essentially of:

a) 0.2 to 1 mol/L of at least one trivalent chromium ion, b) 2 to 10 mol/L of at least one complexing agent, wherein the at least one complexing agent is selected from the group consisting of formic acid, acetic acid, propionic acid, lactic acid, malic acid, citric acid, succinic acid, gluconic acid, glycine, aspartic acid, glutamic acid, and mixtures thereof, or their salts and mixtures thereof, c) 0.01 to 0.5 mol/L of at least one halogen salt, d) 0.01 to 1 mol/L of at least one stabilizing agent, wherein the at least one stabilizing agent is selected from the group consisting of glycolic acid, tartaric acid, pyruvic acid, and mixtures thereof, or their salts and mixtures thereof, e) 0 to 10 g/L of at least one additive, wherein the at least one additive is selected from the group consisting of:

brighteners, wetting agents, and combinations thereof, wherein the electroplating bath has a pH from 4 to 7 and is substantially free of divalent sulphur compounds and boric acid, its salts and/or derivatives and wherein the molar ratio of the complexing agent to the trivalent chromium ion is from 8:1 to 15:1.

22. An electroplating bath for depositing chromium or chromium alloys from a trivalent chromium bath consisting of:

a) 0.2 to 1 mol/L of at least one trivalent chromium ion, b) 2 to 10 mol/L of at least one complexing agent, wherein the at least one complexing agent is selected from the group consisting of formic acid, acetic acid, propionic acid, lactic acid, malic acid, citric acid, succinic acid, gluconic acid, glycine, aspartic acid, glutamic acid, and mixtures thereof, or their salts and mixtures thereof, c) 0.01 to 0.5 mol/L of at least one halogen salt, d) 0.01 to 1 mol/L of at least one stabilizing agent, wherein the at least one stabilizing agent is selected from the group consisting of glycolic acid, tartaric acid, pyruvic acid, and mixtures thereof, or their salts and mixtures thereof, e) 0 to 10 g/L of at least one additive, wherein the at least one additive is selected from the group consisting of:
brighteners,
wetting agents, and
combinations thereof,
wherein the electroplating bath has a pH from 4 to 7 and is substantially free of divalent sulphur compounds and boric acid, its salts and/or derivatives and wherein the molar ratio of the complexing agent to the trivalent chromium ion is from 8:1 to 15:1,
wherein the electroplating bath is substantially free of chloride ions.

* * * * *